US009016934B2

(12) United States Patent
Stranczl et al.

(10) Patent No.: US 9,016,934 B2
(45) Date of Patent: Apr. 28, 2015

(54) ANTI-TRIP BALANCE SPRING FOR A TIMEPIECE

(71) Applicant: Nivarox—FAR S.A., Le Locle (CH)

(72) Inventors: Marc Stranczl, Nyon (CH); Marco Verardo, Les Bois (CH)

(73) Assignee: Nivarox—FAR S.A., Le Locle (CH)

( * ) Notice: Subject to any disclaimer, the term of this patent is extended or adjusted under 35 U.S.C. 154(b) by 0 days.

(21) Appl. No.: 13/945,277

(22) Filed: Jul. 18, 2013

(65) Prior Publication Data

US 2014/0029389 A1 Jan. 30, 2014

(30) Foreign Application Priority Data

Jul. 25, 2012 (EP) ..... 12177895

(51) Int. Cl.
*G04B 17/26* (2006.01)
*G04B 17/06* (2006.01)

(52) U.S. Cl.
CPC ..... *G04B 17/26* (2013.01); *G04B 17/066* (2013.01)

(58) Field of Classification Search
USPC ..... 368/127, 129–131, 175–178
See application file for complete search history.

(56) References Cited

U.S. PATENT DOCUMENTS

| | | | | |
|---|---|---|---|---|
| 273,138 | A * | 2/1883 | Oldroyd | 368/176 |
| 2,526,620 | A * | 10/1950 | Jeanneret | 74/1.5 |
| 3,041,819 | A | 7/1962 | Ensign et al. | |
| 3,638,419 | A * | 2/1972 | Diersbock | 368/175 |
| 3,696,687 | A | 10/1972 | Harland | |
| 2006/0072376 | A1* | 4/2006 | Gabus et al. | 368/127 |
| 2007/0140066 | A1* | 6/2007 | Lechot et al. | 368/127 |
| 2010/0149927 | A1 | 6/2010 | Zaugg et al. | |
| 2011/0310711 | A1* | 12/2011 | Bifrare et al. | 368/177 |
| 2012/0075963 | A1 | 3/2012 | Zaugg | |
| 2012/0113763 | A1* | 5/2012 | Queval | 368/127 |
| 2012/0113765 | A1* | 5/2012 | Queval | 368/127 |

FOREIGN PATENT DOCUMENTS

| | | |
|---|---|---|
| DE | 1 206 811 | 12/1965 |
| EP | 1 666 990 A2 | 6/2006 |
| EP | 1 801 668 A1 | 6/2007 |
| EP | 2 196 867 A1 | 6/2010 |
| EP | 2 434 353 A1 | 3/2012 |
| EP | 2 450 756 A1 | 5/2012 |

OTHER PUBLICATIONS

European Search Report issued Feb. 4, 2013, in European Patent Application No. 12177895.5, filed Jul. 25, 2012.

* cited by examiner

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

An anti-trip mechanism includes a flange with a radial travel limiting channel and a balance spring with a strip wound into a plurality of coils. The balance spring includes an inner coil fixed, at a first end, to a collet coaxial to the balance spring relative to a pivot axis, and an outer coil fixed, at a second, opposite end, to a hooking element. A coil of the balance spring includes a finger that includes a feeler spindle stud that is mounted integrally with the coil. The feeler spindle stud is moveable without any contact, during the normal extension and contraction of said balance spring, in the radial travel limiting channel of the flange. The radial travel limiting channel limits travel of the finger relative to the pivot axis when an angle of pivoting imparted to the collet is greater than a determined nominal value.

14 Claims, 6 Drawing Sheets

ANTI-TRIP BALANCE SPRING FOR A TIMEPIECE

This application claims priority from European Patent Application No. 12177895.5 filed Jul. 25, 2012, the entire disclosure of which is incorporated herein by reference.

FIELD OF THE INVENTION

The invention concerns a balance spring with at least one blade or strip wound into a plurality of coils, wherein among said coils, at a first end, an inner coil is fixed to a collet coaxial to said balance spring relative to a pivot axis, and, at a second, opposite end, an outer coil is fixed to a hooking element.

The invention also concerns an anti-trip mechanism for a timepiece regulating member comprising at least one balance spring with a strip wound into a plurality of coils, wherein, at a first end, an inner coil is fixed to a collet coaxial to said balance spring relative to a pivot axis, and at a second, opposite end, an outer coil is fixed to a hooking element.

The invention further concerns a timepiece movement comprising a regulating member with a sprung balance resonator comprising at least one anti-trip mechanism, and wherein said at least one balance spring is mounted on a balance staff pivoting between a plate and a flange.

The invention also concerns a method of manufacturing an anti-trip mechanism comprising a first step: taking a substrate comprising a top layer and a bottom layer made of silicon-based materials.

The invention concerns the field of regulating members for timepieces and more specifically balance springs.

BACKGROUND OF THE INVENTION

In mechanical watches, escapements have to satisfy several safety criteria. One of the safety devices, the anti-trip system, is designed to prevent the angular extension of the balance beyond a normal angle of rotation. This anti-trip system limits the angle of pivoting of a balance during excessive accelerations, in particular in the event of shocks. This system is essential for certain types of escapement, in particular detent escapements. The anti-trip mechanism must be capable of acting in both directions of pivoting of the balance, i.e. both during extension and contraction of the balance spring.

EP Patent 1801 668 B1 in the name of Montres Breguet SA proposes a system whose structure is characterized in that it includes a pinion mounted on the balance staff. This pinion meshes with a toothed wheel, at least one crossing of which abuts against a fixed stop if the balance is driven beyond its normal angle of rotation. However, this mechanism has an effect on the inertia of the balance and may disturb its oscillations. The gearing comprised therein generates friction which impairs efficiency and may also disturb the regulating system.

EP Patent Application No 1 666 990 A2 in the name of Montres Breguet SA discloses another anti-trip system based on the expansion of the balance spring. A locking arm, fixed to the outer coil of the balance spring, is inserted between a finger integral with the balance and two columns integral with the balance bar. Locking only occurs in the event of excessive expansion of the balance spring beyond an angle exceeding its normal operating angle. However, this mechanism only limits the angle of rotation in one direction of rotation, whereas it is preferable to limit the angle of rotation in both directions of rotation.

A system disclosed in EP Patent No 2450756 A1 in the name of Nivarox-Far SA uses a plate integral with the balance which guides a pin in a spiral-shaped groove. During abnormal oscillations, the pin, integral with a pivoting arm, is stopped and abruptly limits the oscillation. The friction inherent in this mechanism causes interference in the balance throughout its oscillations.

EP Patent No 2 196 867 A1 in the name of Montres Breguet SA discloses a silicon balance spring with a raised coil, which includes an outer coil and an end coil which are connected to each other by a raising device which may include braces used as connecting members or spacers between these two coils. The coils have no contact with other components except the actual balance spring.

U.S. Pat. No. 3,041,819 A in the name of George Ensign discloses a sprung balance with balance spring expansion limiting means, which are formed, on the one hand, by a pin mounted on the balance and extending parallel to the axis thereof, and on the other hand, by a stop block secured to an outer coil of the balance spring.

U.S. Pat. No. 3,696,687 A in the name of Philip Harland discloses a plastic hairspring, which includes a large number of connecting bridges to allow material to flow during moulding, these bridges then being cut to release the coils, without having any other particular function.

EP Patent No 2 434 353 A1 in the name of Montres Breguet SA discloses an anti-trip balance spring wherein notches pertaining to consecutive coils are hooked to each other, both during contraction and extension of the balance spring.

SUMMARY OF THE INVENTION

Thus the present invention is designed to overcome these prior art problems, by not disturbing the inertia of the balance and by limiting the angular travel of the balance in both directions of rotation.

The invention proposes to combine the advantages of the mechanisms disclosed in EP Patent No 1 666 990 A2 and EP Patent Application No 101899987, and to propose a reliable solution, with a small number of components, capable of being made using technologies linked to the manufacture of balances and balance springs made of micromachinable materials.

The invention therefore concerns a balance spring with at least one blade or strip wound into a plurality of coils, wherein among said coils, at a first end, an inner coil is fixed to a collet coaxial to said balance spring relative to a pivot axis, and, at a second, opposite end, an outer coil is fixed to a hooking element, characterized in that at least one said coil of said balance spring carries or includes at least one finger, mounted integrally with said at least one coil.

According to a feature of the invention, said finger includes at least one feeler spindle, which develops, in a preferably substantially parallel direction to said pivot axis, substantially perpendicularly to a plane into which said coils extend.

The invention also concerns an anti-trip mechanism for a timepiece regulating member comprising at least one balance spring with a strip wound into a plurality of coils, wherein, at a first end, an inner coil is fixed to a collet coaxial to said balance spring relative to a pivot axis, and at a second, opposite end, an outer coil is fixed to a hooking element, characterized in that at least one said coil of said balance spring includes at least one finger mounted integrally with said at least one coil and moveable without any contact, during the normal extension or contraction of said balance spring, in a travel limiter channel comprised in a flange of said anti-trip mechanism, and said channel being configured to limit the travel of said finger relative to said pivot axis when the pivoting angle imparted to said collet is greater than a determined nominal value.

The invention further concerns a timepiece movement including a regulating member with a sprung balance resonator comprising at least one anti-trip mechanism, and wherein said at least one balance spring is mounted on a balance staff pivoting between a plate and a said flange, characterized in that said strip of said balance spring is extended by a resilient self-locking washer forming said collet to position said balance spring on said balance staff, to control the distance and orientation of the point of origin of an Archimedes' spiral over which said strip extends relative to the pivot axis of said balance.

The invention also concerns a method of manufacturing an anti-trip mechanism comprising a first step:

a) taking a substrate comprising a top layer and a bottom layer made of silicon-based materials;

characterized in that the method further includes the following steps:

b) selectively etching at least one cavity in said top layer to define at least one silicon-based finger of said coil;

c) fixing an additional layer of silicon-based material onto said top etched layer of said substrate;

d) selectively etching at least one cavity in said additional layer to continue the pattern of said at least one finger and to define the patterns of a balance spring and of an element and of a collet in silicon-based material of said balance spring;

e) selectively etching at least one cavity in said bottom layer to continue the pattern of said at least one finger and to define the pattern of a flange comprising at least one travel limiter channel for said at least one finger;

f) releasing the anti-trip mechanism from said substrate.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
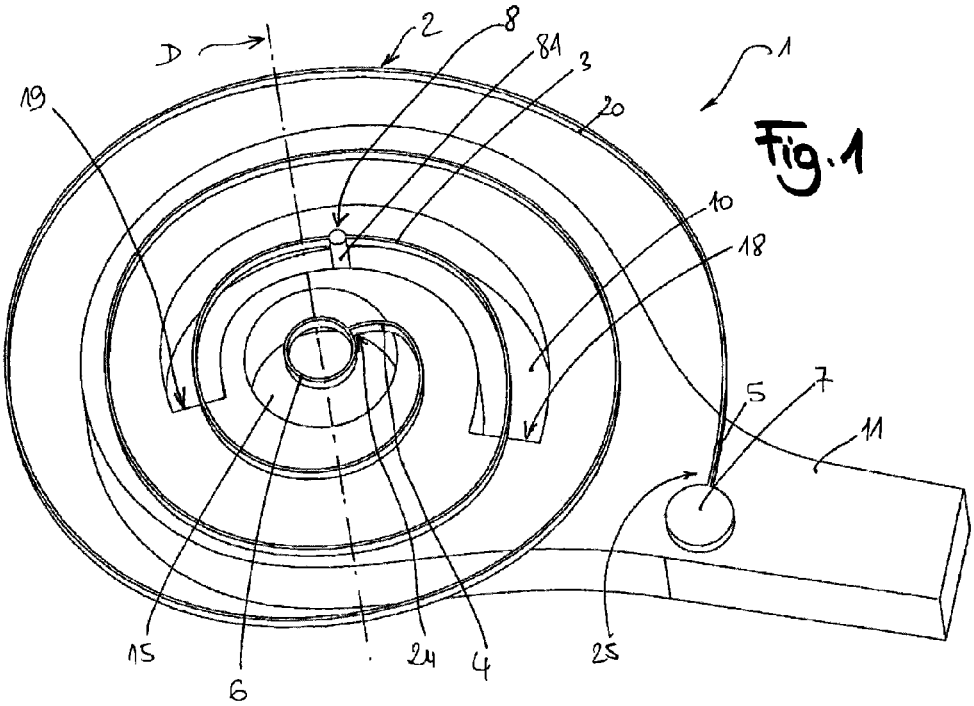
FIG. 1 shows a schematic, perspective view of an anti-trip device according to the invention, seen from the side of a balance spring included therein and which is shown in a rest position.

The invention concerns the field of regulating members for timepieces and more specifically balance springs.

The present invention is designed to overcome prior art problems, by not disturbing the inertia of the balance and in particular reducing friction to a minimum during operation, and by limiting the angular travel of the balance in both directions of rotation.

Thus, the invention concerns a balance spring 2 with at least one blade or strip 2 wound into a plurality of coils 3. Among these coils 3, at a first end 24, an inner coil 4 is fixed to a collet 6 coaxial to balance spring 2 relative to a pivot axis D. At a second, opposite end 25, an outer coil 5 is fixed to a hooking element 7.

According to the invention, at least one coil 3 of balance spring 2 carries or includes at least one finger 8. This finger 8 is mounted integrally with said at least one coil 3. Preferably, this finger 8 includes at least one feeler spindle stud 81, which develops in a preferably substantially parallel direction to pivot axis D, i.e. substantially perpendicularly to a plane into which the various coils 3 extend.

A distinction is made between feeler spindle stud 81 and the actual finger 8, because of the direction of feeler spindle stud 81 parallel to the axis. This feeler spindle stud 81 is sized to cooperate with a path similar to a cam path.

The invention also concerns an anti-trip mechanism 1 for a timepiece regulating member 100. This mechanism 1 includes at least one balance spring 2.

Finger 8 of the balance spring is mounted integrally with said at least one coil 3 and the at least one feeler spindle stud 81 is moveable without any contact, during the normal extension or contraction of balance spring 2, in at least one travel limiter channel 10 comprised in at least one flange 11 of anti-trip mechanism 1. The at least one flange 11 preferably extends in a parallel plane to the plane in which the various coils 3 extend.

The at least one channel 10 is configured to limit the travel of finger 8 relative to pivot axis D, when the pivoting angle imparted to collet 6 is greater than a determined nominal value, particularly during a strong acceleration due to a shock or suchlike.

The limitation of the travel of finger 8, more particularly of the feeler spindle stud 81 thereof, may be achieved differentially. A channel 10 may comprise both an inner limiter path and an outer limiter path as in FIGS. 2 to 9, where each channel 10 includes an inner surface 12 and an outer surface 13. It may also, in a variant not shown in the Figures, have only an inner path, or only an outer path: for example finger 8 of the balance spring is moveable between two flanges 11, each including a channel 10, wherein one has an inner path, and the other an outer path; in this case finger 8 has two feeler spindles 81, on either side of balance spring 2. This variant also prevents any inadvertent twisting of the balance spring, for example in the event of a shock.

Figure 2:
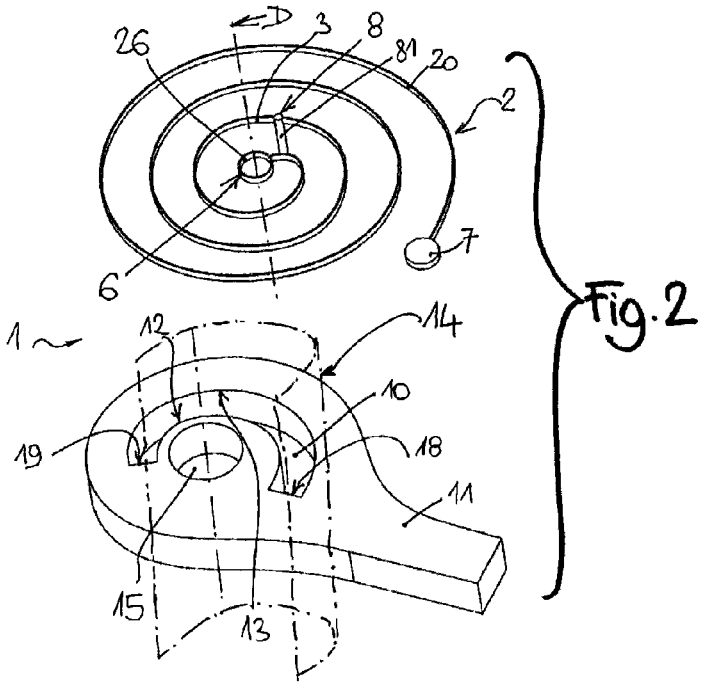
FIG. 2 shows a schematic, perspective, exploded view of an anti-trip mechanism of this type, in an embodiment having several components.
Figure 3:
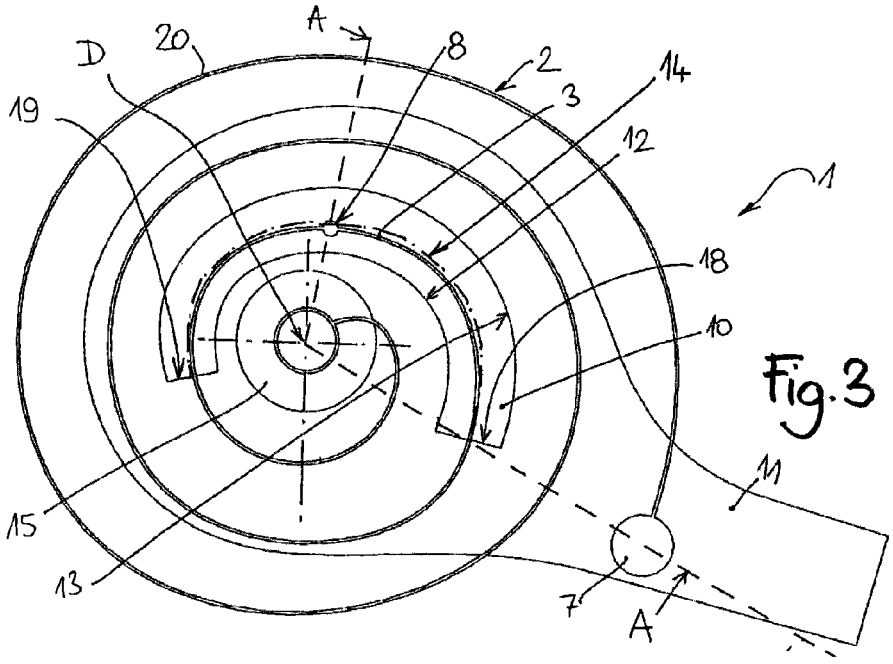
FIG. 3 shows a schematic, plan view of an anti-trip device according to the invention, with the balance spring shown in a rest position.

FIGS. 1 to 3 show the same mechanism 1 with balance spring 2 in a rest position. Finger 8 then has no contact with the walls of channel 10.

Preferably, this channel 10 develops substantially symmetrically, or symmetrically, on both sides of a median surface 14, which extends parallel to pivot axis D, and which, in a perpendicular plane to said axis, has a preferably helical coil-shaped profile, which adopts the profile of coil 3 carrying finger 8 in this rest position. Naturally, surface 14 may adopt similar profiles, for example a cylindrical or similar sector. In the particular and non-limiting embodiment illustrated in FIGS. 1 to 6, channel 10 is delimited, in a direction called the "longitudinal direction", by two end surfaces 18 and 19, respectively corresponding to the position of maximum extension of balance spring 2, and to the position of maximum contraction of the balance spring. It is further delimited, in a direction called the "radial direction", by an inner surface 12, and by an outer surface 13. Naturally, the contour of channel 10 may be continuous, and formed of a single surface of variable concavity, parallel to pivot axis D.

The travel of finger 8 is thus limited by channel 10 in all directions of the plane.

Thus, finger 8 is remote from inner edge 12 and outer edge 13 of channel 10 in normal operation, and preferably the intrinsic trajectory of finger 8 is identical to the geometry of a median surface 14 equidistant from edges 12 and 13.

Figure 4:
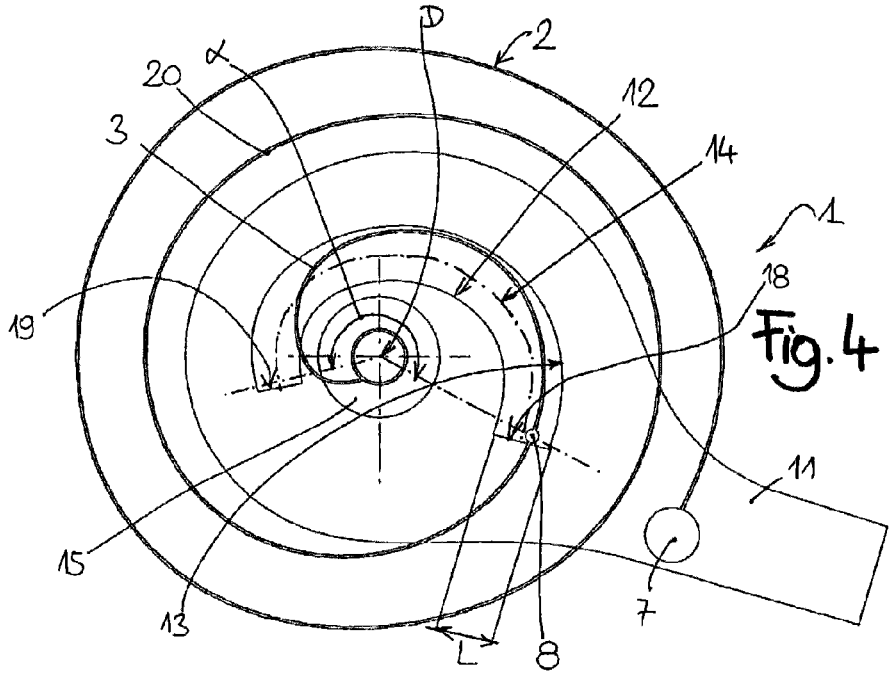
FIG. 4 shows the mechanism of FIG. 3, with the balance spring in a position of maximum extension.
Figure 5:
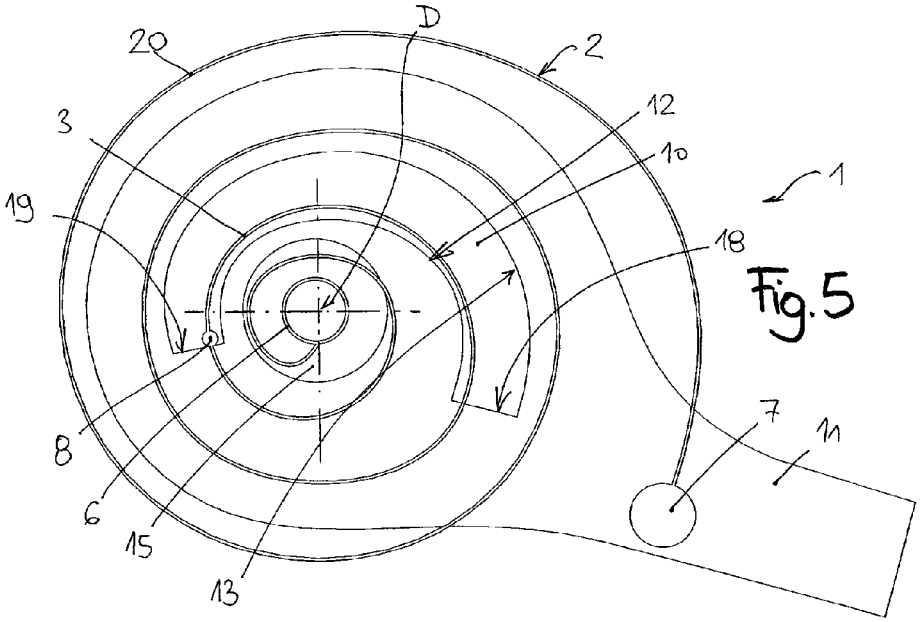
FIG. 5 shows the mechanism of FIG. 3, with the balance spring in a position of maximum contraction.

As seen in FIG. 4, the angle at the centre a, centred on pivot axis D, between the extreme points of end surfaces 18 and 19, preferably corresponds to the maximum angular amplitude given to the finger 8 corresponding to the channel 10 concerned, fixed to collet 6. This angle depends on the amplitude of a balance 30 whose staff 31 is driven into a self-locking washer 26 forming collet 6. In this regard, the collet is preferably formed in the shape of an elastic star having several arms, exerting a tightening force distributed over the circumference of staff 31. Depending on the proximity of the coil 3 carrying finger 8, to pivot axis D, the curvilinear distance between end surfaces 18 and 19 is variable, with the distance becoming greater the further the coil 3 concerned is away from axis D. For example, the angle $\alpha$ for a channel 10 of a coil 3 close to the centre may be close to 300°, whereas it will be greater, and may exceed one revolution, for a channel of a fifth coil, the coil-shaped path of each channel 10 allowing all angle values. Thus, angle $\alpha$ depends on the distance from the pivot axis (in terms of the number of coils separating finger 8 from axis D), and on the amplitude of the balance, and must therefore be adapted accordingly.

In the radial direction, inner surface 12 and outer surface 13 are separated by a distance which may be variable or constant, depending on the embodiment selected. The maximum value of this distance taken perpendicularly to axis D will be referred to as "L" here.

Figure 6:
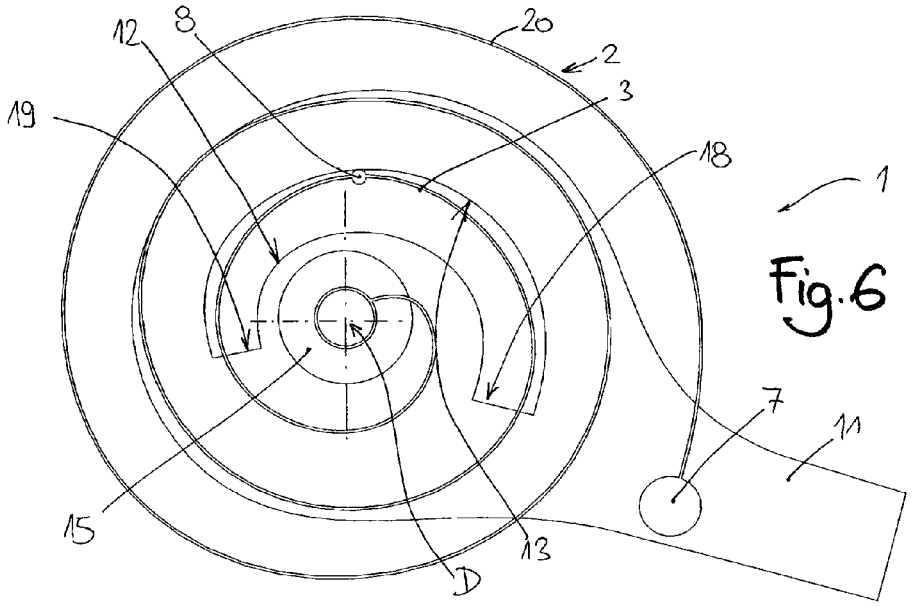
FIG. 6 shows the mechanism of FIG. 3, in a position where a shock is applied to the balance spring or to the mechanism, during which a finger carried by a coil of the balance spring comes into contact with a limiter channel comprised in a flange of the mechanism of the invention.

FIG. 6 illustrates the configuration when a shock is applied to balance spring 2 or to mechanism 1. In the event of a shock, finger 8, or at least one finger 8 if there are several, comes into contact with one of the inner surfaces of limiter channel 10 formed in flange 11.

Figures 7, 7A, 8, 9:
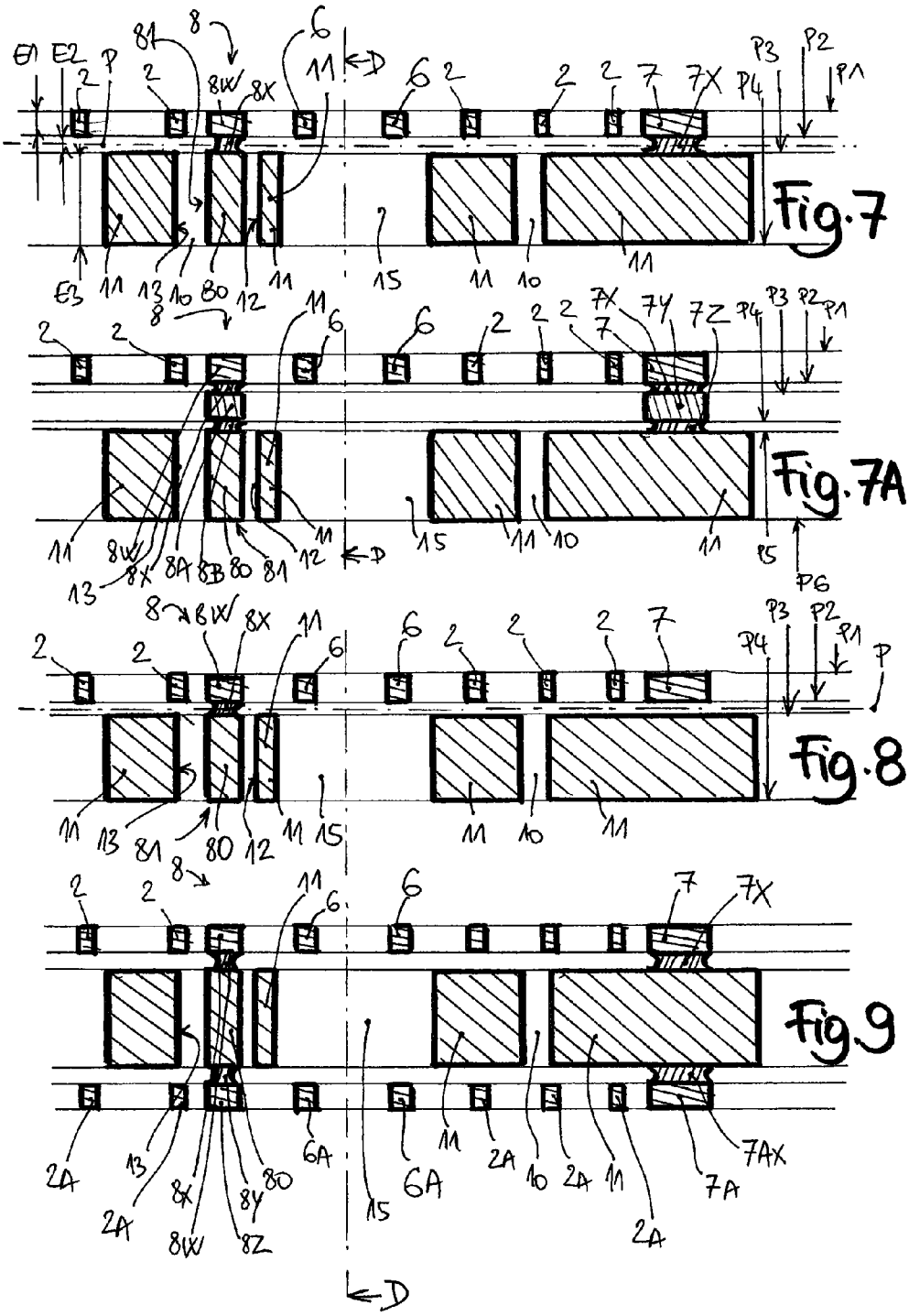
FIG. 7 shows a section of the mechanism of FIG. 3 along line AA, this mechanism being shown in a particular single-piece variant made of micromachinable material, derived from a wafer having three layers, and wherein a hooking element is integral with the flange.
FIG. 7A shows, in a similar manner to FIG. 7, another variant, derived from a wafer having five layers, wherein an intermediate layer of silicon between two oxide layers determines the dimension of an operating distance between the balance spring and the flange, which is much greater than that obtained according to FIG. 7.
FIG. 8 shows, in a similar manner to FIG. 7, another variant wherein the hooking element is free relative to the flange.
FIG. 9 shows, in a similar manner to FIG. 7A, another variant wherein the mechanism according to the invention includes two balance springs on either side of a single flange.

In an advantageous and non-limiting embodiment illustrated in FIG. 7, hooking element 7 is fixed to flange 11 or is integral therewith by design. In other embodiments, particularly in FIG. 8, this hooking element 7 is free relative to flange 11, and is then fixed to a plate 32, to a bridge, or other element.

In the variants illustrated in FIGS. 1 to 8, balance spring 2 extends on a first side from a delimiting plane P, on the other side of which there extends flange 11, at least in the maximum projected surface of balance spring 2.

In a particular embodiment, balance spring 2 is made in a single-piece with collet 6 or a self-locking washer 26 forming said collet 6, and with hooking element 7, as seen in FIG. 2.

In a preferred embodiment, balance spring 2 is made in a single piece with collet 6 or a self-locking washer 26 forming said collet 6 and with hooking element 7 and with flange 11, as seen in FIGS. 7 to 9.

A first thickness level E1 includes, between two parallel planes P1 and P2, perpendicular to axis D, balance spring 2, collet 6 and hooking element 7, in addition to a first section 8W of each finger 8.

A second thickness level E2 includes, between two parallel planes P2 and P3 perpendicular to axis D, at least a second section 8X of each finger 8, as seen in FIG. 8. In the preferred case of FIG. 7, this second level also includes a connecting section 7X between hooking element 7 and flange 11.

Figure 10:
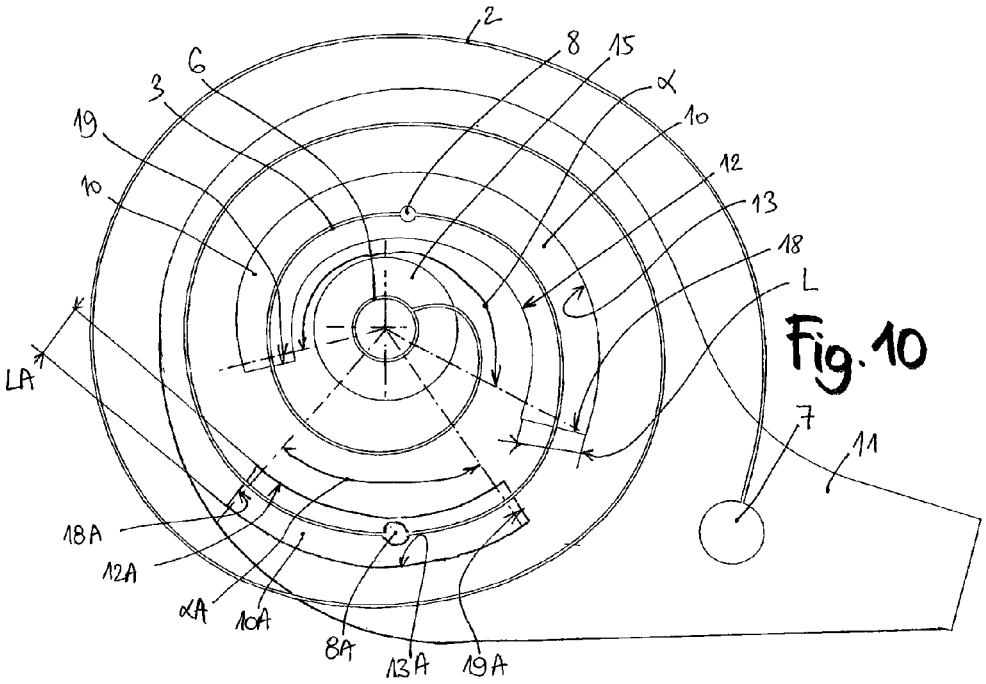
FIG. 10 shows, in a similar manner to FIG. 3, an alternative mechanism of the invention, with a balance spring carrying several fingers, wherein the movement of each is limited by a particular limiter channel.

A third thickness level E3 includes, between two parallel planes P3 and P4 perpendicular to axis D, a third section 80 of each finger 8, and flange 11 or at least a portion thereof. Flange 11 includes a central aperture 15 for the passage of a moveable element secured to collet 6, and in particular a staff 31 of a balance 30. Flange 11 includes a limiter channel 10 around each finger 8. Naturally, the same limiter channel 8 may be suitable for receiving several fingers 8, but in that case, where it provides radial limitation for said fingers, it only provides partial longitudinal limitation, i.e. only on one side, or not at all. Thus the preferred embodiment consists in allocating a limiter channel 10 to each finger 8, as seen in FIG. 10 where these channels 10 are not consecutive. This configuration also provides some progressiveness to the anti-trip action of mechanism 1, by limiting the travel of the various fingers 8 in a different manner, by giving their limiter channels 10 a different profile, either in angular limitation, as in FIG. 8 where the angle at the centre $\alpha$ of the innermost channel 10 is greater than that $\alpha$A of the outermost channel 10A, or in radial limitation as in the same Figure where the respective widths L and LA are different, or by a combination of these limitations or simply by the actual shape of the contour of each of limiter surfaces 10.

In an advantageous variant embodiment, balance spring 2 is devised so that its centre of gravity is always centred during angular deformation of the balance spring.

In a preferred variant embodiment seen in FIGS. 7 to 9, anti-trip mechanism 1 is made entirely of micromachinable material, preferably single crystal or polycrystalline silicon and/or silicon oxide, with SOI wafers, balance spring 2 being etched in a device layer, and flange 11 and third portion 80 of finger 8 being etched in a handle layer. This embodiment is suitable for execution of the variants illustrated in FIGS. 1 and 3 to 6 and 10, and in particular for obtaining a very small distance between balance spring 2 and flange 11, typically of around a micrometer.

Figure 13:
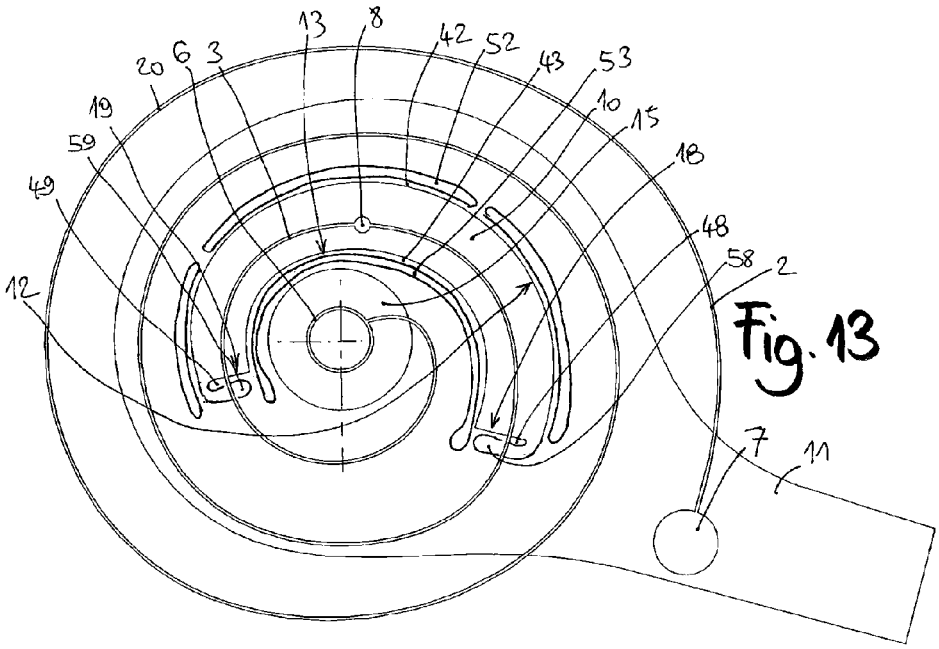
FIG. 13 shows a schematic, plan view of a variant of FIG. 3, with peripheral surfaces of the limiter channel including a damping means.

Execution in micromachinable material also allows the execution of a FIG. 13 variant, with the peripheral surfaces of limiter channel 10 including damping means: elastic lugs 48 and 49 at end surfaces 18 and 19, mobile between channel 10 and a chamber 58, 59, thin elastic walls 42 and 43 on inner surface 12 and outer surface 13, separating channel 10 from pockets 52, 53.

FIG. 9 illustrates a variant of anti-trip mechanism 1 which includes a second, coaxially-mounted balance spring 2A, the second balance spring 2A and balance spring 2 being etched in two outer layers, and flange 11 and third portion 80 of finger 8 being etched in an inner layer.

Figure 11:
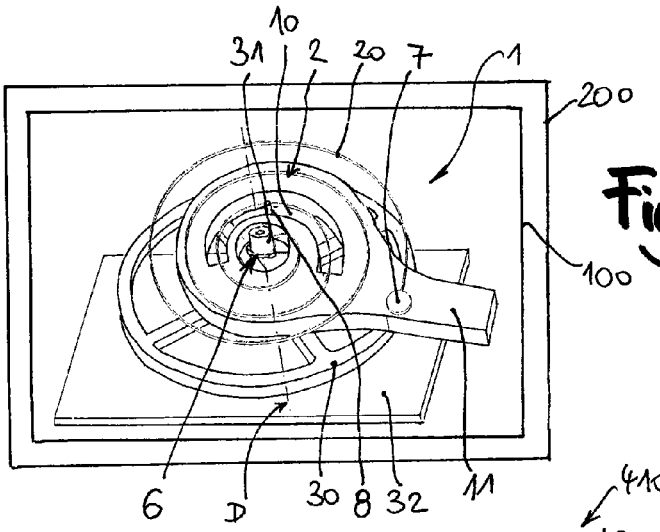
FIG. 11 shows, in a block diagram, a timepiece movement including a sprung balance regulating member, which includes an anti-trip mechanism according to the invention, wherein the balance spring is secured via its collet to the balance pivoting relative to a plate.

As seen in FIG. 11, the invention also concerns a timepiece movement 200 comprising a regulating member 100 with a sprung balance resonator comprising at least one anti-trip mechanism 1, and wherein the at least one balance spring 2 is mounted on a staff 31 of a balance 30 pivoting between a plate 32 and a flange 11, which is advantageously that of mechanism 1. According to the invention, strip 20 of balance spring 2 is extended by a resilient, self-locking washer 26 forming collet 6 to position balance spring 2 on staff 31 of balance 30, to control the distance and orientation of the point of origin of an Archimedes' spiral along which strip 20 extends relative to pivot axis D of balance 30.

Flange 11 is secured to plate 32. Advantageously, the position thereof is adjustable, particularly angularly, so that it is easy to put the balance spring into beat, and in particular to adjust the rest point.

Various manufacturing methods may be used in order to make an anti-trip mechanism 1 according to the invention in a single-piece.

By way of non-limiting example, the embodiment made of micromachinable material may be achieved by one of the following methods:

The conventional method for making mechanism 1 of FIG. 7, or that of FIG. 8, consists in implementing an SOI wafer, with two silicon levels, and an oxide layer, particularly $SiO_2$. The wafers are formed of three sandwiched layers. The thickness of the intermediate oxide layer, 8X, 7X, between planes P2 and P3, is around 2 μm, the thickness of the bottom, outer, layer of silicon between planes P3 and P4, is typically 300 μm, and the top, silicon layer between planes P1 and P2, 100 μm. In this case, in FIG. 7, the distance between the coils 3 of spring 2 and element 11 is 2 μm and is defined by the oxide.

After forming the wafer, the first step consists in performing an etch of the top silicon layer, to clear the contours of the components required to remain, here balance spring 2, collet 6, hooking element 7 and top portion 8W of finger 8, and in stopping the etch at the boundary of the oxide layer.

The second step consists in performing the etch of the bottom silicon layer to clear the contours of the components required to remain, here flange 11 and body 80 of feeler spindle stud 81 of finger 8, and in stopping the etch at the boundary of the oxide layer.

The third step consists in performing the etch of the intermediate silicon oxide layer, to leave only the connecting areas: 8X in finger 8 between top portion 8W and body 80 on the one hand, and 7X between hooking element 7 and flange 11 on the other hand.

Another method for making mechanism 1 of FIG. 7A or that of FIG. 9 consists in implementing an SOI wafer with three silicon levels, and two oxide levels separating them in pairs: an additional layer is added to an SOI silicon wafer base (in fact an oxide layer, typically 2 μm and a silicon layer, typically 100 μm are added). In that case, in FIG. 7A, the layer between coils 3 of balance spring 2 and element 11, between plane P3 and plane P4, is 100 μm and is defined by a silicon layer 8A, 7Y. The oxide is no longer a functional layer. This is advantageous since coils 3 of balance spring 2 are not likely to stick to element 11. With this second method it is possible to make the FIG. 9 variant with a distance of 2 μm between coils 3 of balance spring 2 and element 11, which is defined by oxide layers 8X, 7X, and a distance of 2 μm between the coils of balance spring 2A and element 11, which is defined by oxide layers 8Y and 7AX.

Figure 12:
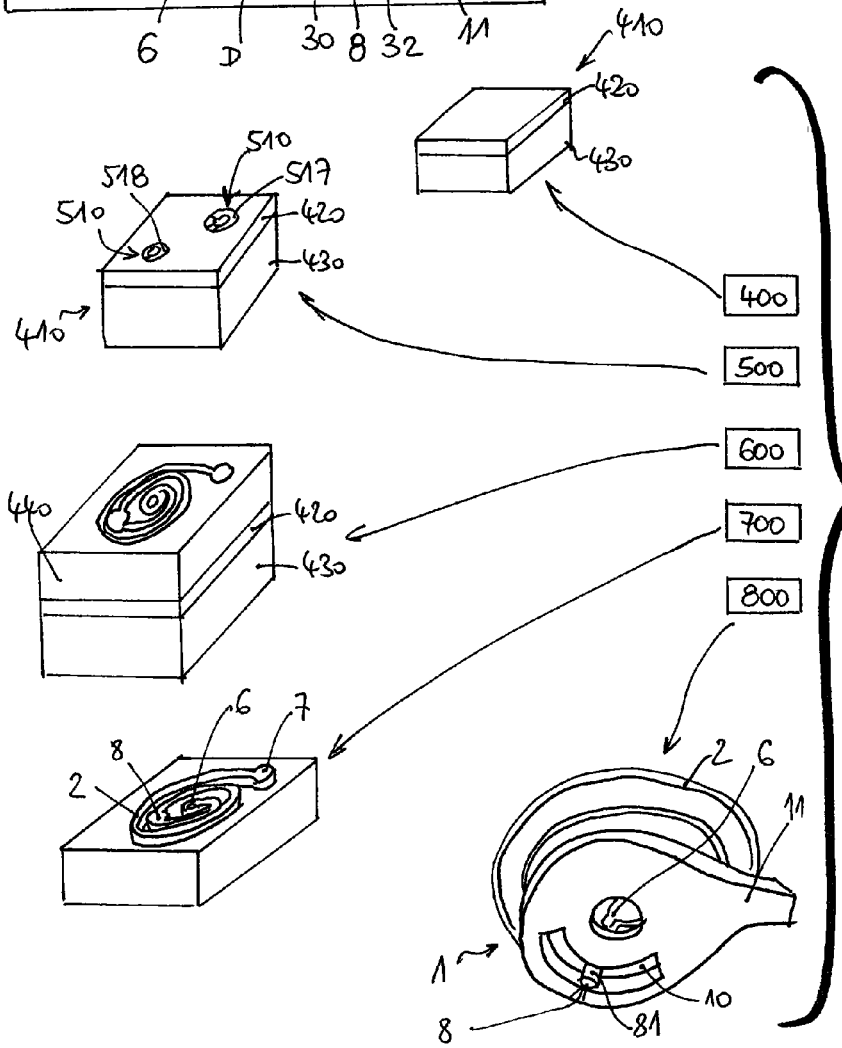
FIG. 12 shows, in a schematic manner, a series of operations of a basic method for making an anti-trip mechanism according to the single-piece variant of FIG. 7A made in micromachinable material.

The sequence whereby the first method can be achieved, in the FIG. 7A example and as shown in FIG. 12, includes a first step:

a) taking 400 a substrate 410 comprising a top layer 420 and a bottom layer 430 made of silicon-based materials.

This method further includes the following steps:

b) selectively etching 500 at least one cavity 510 in the top layer 420 to define at least one finger 8 of silicon-based material of balance spring 2;

c) fixing 600, to the top etched layer 420 of substrate 400, an additional layer 440 of silicon-based material;

d) selectively etching 700 at least one cavity 710 in the additional layer 440 to continue the pattern of the at least one finger 8 and to define the patterns of a balance spring 2 and of a hooking element 7 and of a collet 6 of silicon-based material of the balance spring;

e) selectively etching 800 at least one cavity 810 in the bottom layer 430 to continue the pattern of the at least one finger 8 and to define the pattern of a flange 11 including at least one channel 10 for limiting the travel of the at least one finger 8;

f) releasing 900 the anti-trip mechanism 1 from the substrate 41.

Those skilled in the art may naturally provide variants to this method, or implement similar methods, in particular following the teaching of the Patent Applications published by Nivarox-Far SA relating to the development of balance springs or timepiece movement components made of micromachinable materials. The materials selected for a high modulus of elasticity, particularly higher than 50000 $N/mm^2$ and in particular higher than 100000 $N/mm^2$ are advantageously selected from among metallic glasses or at least partially amorphous materials.

Preferably, the nominal value determined for maximum angular elongation $\alpha$ is preferably 300°.

The positioning of finger 8 is preferably achieved on one of the coils close to the axis as illustrated in FIGS. 1 to 6.

In short, the principle of the invention is to use this finger 8, in conjunction with limiter channel 10, to limit the amplitude of balance spring 2. In normal operation, finger 8 does not rub against channel 10 since its intrinsic trajectory is identical to the geometry of channel 10. Channel 10 is sized so as to limit the travel of balance 30 in the event of excessive amplitudes. The coils 3 located between finger 8 and pivot axis D, which still operate during excessive amplitudes, determine the rigidity of anti-trip mechanism 1 according to the invention. The variant comprising several fingers 8, each in a channel 10 pertaining thereto, makes the action of mechanism 1 progressive, by differentially changing the number of coils 3 of the spring that remain operational.

With a mechanism of very small thickness which does not impair the total thickness of the movement, the invention provides the required advantages:

the inertia and movement of the sprung balance system are not disturbed during the normal travel of the system owing to the fact that finger 8 does not rub in its channel 10 during normal operation;

the amplitude limitation provided by mechanism 1 according to the invention operates in both directions of rotation.

What is claimed is:

1. An anti-trip mechanism for a timepiece regulating member comprising:

a flange that includes a radial travel limiting channel; and at least one balance spring with a strip wound into a plurality of coils, said balance spring including an inner coil fixed, at a first end, to a collet coaxial to said balance spring relative to a pivot axis, and an outer coil fixed, at a second, opposite end, to a hooking element, wherein at least one coil of said balance spring includes at least one finger that includes at least one feeler spindle stud that is mounted integrally with said at least one coil, the balance spring positioned relative to the flange so that said at least one feeler spindle stud is moveable without any contact, during the normal extension and contraction of said balance spring, in the radial travel limiting channel of the flange, said radial travel limiting channel being configured to limit travel of said finger relative to said pivot axis when an angle of pivoting imparted to said collet is greater than a determined nominal value.

2. The anti-trip mechanism according to claim 1, wherein said at least one feeler spindle stud extends in a substantially parallel direction to said pivot axis, substantially perpendicularly to a plane in which said inner and outer coils extend.

3. The anti-trip mechanism according to claim 1, wherein said hooking element is fixed to said flange.

4. The anti-trip mechanism according to claim 1, wherein said balance spring extends on a first side from a delimiting plane on the other side of which extends said flange, at least in a maximum projected surface of said balance spring.

5. The anti-trip mechanism according to claim 1, wherein said channel is coil-shaped.

6. The anti-trip mechanism according to claim 1, wherein said finger is remote from edges of said channel in normal operation, and wherein an intrinsic trajectory of said finger is identical to a geometry of a median surface equidistant from said edges of said channel.

7. The anti-trip mechanism according to claim 1, wherein said balance spring is manufactured in a single-piece with said collet, said hooking element and said flange.

8. The anti-trip mechanism according to claim 7, wherein the anti-trip mechanism is entirely made of single crystal or polycrystalline silicon with SOI wafers, said balance spring being etched in a device layer, and said flange and said finger being etched in a handle layer.

9. The anti-trip mechanism according to claim 7, wherein the anti-trip mechanism is entirely made of silicon with SOI wafers, and includes a second coaxially mounted balance spring, said second balance spring and said balance spring being etched in two outer layers, and said flange and said finger being etched in an inner layer.

10. The anti-trip mechanism according to claim 1, wherein said balance spring includes a plurality of fingers and the flange includes a corresponding number of radial travel limiting channels, each of the plurality of fingers cooperating with a corresponding one of said radial travel limiting channels.

11. The anti-trip mechanism according to claim 10, wherein said radial travel limiting channels are not continuous with each other.

12. A timepiece movement including a regulating member with a sprung balance resonator comprising at least one anti-trip mechanism according to claim 1, wherein said at least one balance spring is mounted on a staff of a balance pivoting between a plate and a said flange, wherein said strip of said balance spring is extended by a resilient self-locking washer forming said collet to position said balance spring on said staff of said balance, to control the distance and orientation of the point of origin of an Archimedes' spiral over which said strip extends relative to the pivot axis of said balance.

13. A method of fabricating an anti-trip mechanism comprising:

a) taking a substrate comprising a top layer and a bottom layer made of silicon-based materials;

b) selectively etching at least one cavity in said top layer to define at least one finger of silicon-based material of said balance spring;

c) fixing an additional layer of silicon-based material to said top etched layer of said substrate;

d) selectively etching at least one cavity in said additional layer to continue the pattern of said at least one finger and to define the patterns of a balance spring and of a hooking element and of a collet of silicon-based material of said balance spring;

e) selectively etching at least one cavity in said bottom layer to continue the pattern of said at least one finger and to define the pattern of a flange including at least one channel for limiting the travel of said at least one finger;

f) releasing the anti-trip mechanism from said substrate.

14. The method according to claim 13, wherein said anti-trip mechanism is made entirely of silicon with SOI wafers, said balance spring on the one hand, and a portion of said at least one finger fixed to said balance spring and located between two parallel planes defining the boundaries of said balance spring on the other hand, being etched in a device layer, and also said flange on the one hand, and another portion of said at least one finger remote from said balance spring and located outside the space comprised between said two planes on the other hand, being etched in a handle layer.

* * * * *